US006948630B2

(12) United States Patent
Julian et al.

(10) Patent No.: US 6,948,630 B2
(45) Date of Patent: Sep. 27, 2005

(54) SELF-DRAINING CONTAINER NECK AND CLOSURE

(75) Inventors: Randall K. Julian, Newburgh, IN (US); Clayton L. Robinson, Elberfeld, IN (US)

(73) Assignee: Rexam Medical Packaging, Inc., Evansville, IN (US)

( * ) Notice: Subject to any disclaimer, the term of this patent is extended or adjusted under 35 U.S.C. 154(b) by 64 days.

(21) Appl. No.: 10/277,072

(22) Filed: Oct. 21, 2002

(65) Prior Publication Data

US 2003/0116522 A1 Jun. 26, 2003

Related U.S. Application Data

(63) Continuation-in-part of application No. 10/026,161, filed on Dec. 21, 2001.

(51) Int. Cl.[7] ..... B65D 47/00; B65D 39/00; B65D 51/00; B65D 41/00

(52) U.S. Cl. ..... 215/43; 215/252; 215/232; 215/349; 215/329

(58) Field of Search ..... 510/245, 254, 510/369, 372, 421, 506; 134/40, 41, 42; 215/232, 43, 252, 307, 329, 349, 44; 220/288

(56) References Cited

U.S. PATENT DOCUMENTS

| | | | | |
|---|---|---|---|---|
| 1,961,033 | A | | 5/1934 | Bicks |
| 2,085,934 | A | | 7/1937 | Von Till |
| 2,686,607 | A | | 8/1954 | Froitzheim |
| 3,612,325 | A | | 10/1971 | Williams |
| 3,632,004 | A | | 1/1972 | Grimes et al. |
| 3,788,510 | A | | 1/1974 | Collins |
| 3,879,492 | A | | 4/1975 | Bontinick |
| 4,109,815 | A | | 8/1978 | Collins, III |
| 4,181,232 | A | | 1/1980 | Bellamy et al. |
| 4,280,653 | A | | 7/1981 | Elias |
| 4,358,919 | A | | 11/1982 | Hirota et al. |
| 4,392,579 | A | | 7/1983 | Uhlig et al. |
| 4,423,821 | A | | 1/1984 | McIntosh |
| 4,473,163 | A | | 9/1984 | Geiger |
| 4,501,371 | A | | 2/1985 | Smalley |
| 4,583,665 | A | | 4/1986 | Barriac |
| 4,625,875 | A | | 12/1986 | Carr et al. |
| 4,638,913 | A | | 1/1987 | Howe, Jr. |
| 4,842,951 | A | | 6/1989 | Yamada et al. |
| 4,881,649 | A | | 11/1989 | Hsu et al. |
| 4,893,718 | A | | 1/1990 | Delespaul et al. |
| 4,894,266 | A | | 1/1990 | Bauer et al. |
| 4,981,230 | A | * | 1/1991 | Marshall et al. ..... 215/252 |
| 5,002,811 | A | | 3/1991 | Bauer et al. |
| 5,006,384 | A | | 4/1991 | Genske |
| 5,011,719 | A | | 4/1991 | Gehrke et al. |
| 5,023,121 | A | | 6/1991 | Pockat et al. |
| 5,061,532 | A | | 10/1991 | Yamada |
| 5,069,355 | A | | 12/1991 | Matuszak |
| 5,071,686 | A | | 12/1991 | Genske et al. |
| 5,078,290 | A | * | 1/1992 | Ochs ..... 215/252 |
| 5,092,469 | A | | 3/1992 | Takata et al. |
| 5,093,164 | A | | 3/1992 | Bauer et al. |
| 5,110,642 | A | | 5/1992 | Genske |
| 5,151,317 | A | | 9/1992 | Bothe |
| 5,160,767 | A | | 11/1992 | Genske et al. |

(Continued)

*Primary Examiner*—Derris H. Banks
*Assistant Examiner*—Urszula M. Cegielnik
(74) *Attorney, Agent, or Firm*—Middleton Reutlinger

(57) ABSTRACT

A self-draining container neck and closure comprising a container neck having an upper sidewall portion and a lower sidewall portion, the upper sidewall portion being inset from the lower sidewall portion. The container neck also includes a tamper indicating bead having at least one draining notch therein. The instant invention also includes a closure having a plurality of drainage slots disposed in a spaced configuration. The closure is threadably connected to the container neck, the closure and container threads rotatably engage and provide a drainage path there between.

58 Claims, 8 Drawing Sheets

U.S. PATENT DOCUMENTS 5,175,035 A 12/1992 Pinsolle et al.
5,178,293 A 1/1993 Suzuki et al.
5,302,442 A 4/1994 O'Brien et al.
5,346,082 A * 9/1994 Ochs et al. ..... 215/252
5,415,306 A 5/1995 Luch et al.
5,421,470 A 6/1995 Dudzik
5,447,792 A 9/1995 Brandt et al.
5,492,757 A 2/1996 Schuhmann et al.
5,500,265 A 3/1996 Ambroise et al.
5,533,622 A 7/1996 Stockley, III et al.
5,626,929 A 5/1997 Stevenson
5,664,694 A 9/1997 Bietzer et al.
5,773,136 A 6/1998 Alder et al.
5,837,369 A 11/1998 Grunberger et al.
5,851,640 A 12/1998 Schuhmann et al.
5,882,789 A 3/1999 Jones et al.
5,973,077 A 10/1999 Kan et al.
5,992,661 A 11/1999 Zumbuhl
5,997,968 A 12/1999 Dries et al.
6,105,800 A * 8/2000 Czesak ..... 215/42
6,152,316 A * 11/2000 Niese ..... 215/252
6,220,466 B1 4/2001 Hayes et al.
6,231,975 B1 5/2001 Kong et al.
6,235,822 B1 5/2001 Whetten et al.
6,253,940 B1 * 7/2001 Graham et al. ..... 215/252
6,257,430 B1 7/2001 Rinnie et al.
6,265,083 B1 7/2001 Tanizaki et al.
6,276,543 B1 * 8/2001 German et al. ..... 215/252
6,315,140 B1 * 11/2001 Nadel ..... 215/354
6,419,101 B1 * 7/2002 Hessel et al. ..... 215/253
2002/0066713 A1 * 6/2002 Ma ..... 215/252
2003/0071007 A1 * 4/2003 Ma et al. ..... 215/252
2003/0098285 A1 * 5/2003 Gregory et al. ..... 215/252
2003/0116524 A1 * 6/2003 Robinson et al. ..... 215/349
2003/0150833 A1 * 8/2003 Shenkar ..... 215/252

* cited by examiner

SELF-DRAINING CONTAINER NECK AND CLOSURE

CROSS-REFERENCE TO PRIOR APPLICATION

This continuation-in-part application claims priority to U.S. patent application Ser. No. 10/026,161, filed on Dec. 21, 2001.

BACKGROUND OF THE INVENTION

1. Technical Field of the Invention

The present invention relates generally to a container and closure for use in a hot fill or retort process. More particularly, the invention relates to a container neck and closure which promote drainage of hot fill or hot or cold bath water introduced therein during the process.

2. Description of the Related Art

In recent years, packaged products which are room temperature storage stable yet ready-to-use upon opening, i.e. they require no cooking or heating before use, have become extremely popular with the consumer. For many food products, this trend requires only minor packaging changes, such as modifying the package size to be consistent with the anticipated consumer use pattern. However, for products prone to bacterial contamination and spoilage, such as some beverages, soups, and many other food products, this trend presents some major packaging challenges.

For example, certain products need to be sterilized to reduce the initial viable bacterial concentration in a product, thereby reducing the rate at which the product will spoil and lengthening the product's shelf life. One procedure for reducing the viable bacterial concentration is sterilization by hot fill and another by retort processing. In the retort process, a chilled or ambient temperature product is poured into a container and the container is sealed. The container may be sealed by melding two sections of the container material together, such as by heat-sealing a seam on a pouch, or the container may be sealed by bonding a seal to the lip of the container, such as by induction or conduction sealing a foil-lined seal to a barrier polymer material bottle neck. The filled package is then sterilized at high temperature in a high pressure water bath. In a typical commercial production rate retort process, the package is heated from an ambient temperature of about 75° F. to a sterilizing temperature in the range of from about 212° F. to about 270° F.

During this process, retort bath water may be trapped or adhere between the threads of the container and closure making the product aesthetically unacceptable and unpleasant for use by the consumer as well as increasing the probability of bacterial growth within the threaded areas.

In a hot fill situation, the product is heated to between about 150–210 degrees Fahrenheit to kill a majority of the bacteria and then put into the container and a cap is applied. The high temperature product likewise kills the bacteria on the inside of the container and closure or closure seal. Soon after filling, to reduce the likelihood of distortion to the package and facilitate further handling and operations such as labeling and cartoning, the package is cooled. In some cases the package is simply sprayed with cool water but in some cases, where a more complete cooling is desired, the filled and capped package is submerged in cool water.

In a case where a peelable, tabbed or oversize innerseal liner is used, the small crevices around the tabs or overhead exacerbate the problem of retained water. And, should a shrink sleeve be desirable to be applied over the cap and neck for tamper-indication, this further may tend to inhibit drainage or drying and allow time for bacteria or mold to grow in the wetted areas.

In view of the deficiencies in known closures and container necks associated with hot fill and retort processes, it is apparent that a container neck and closure is needed which promotes drainage of cooling water introduced therein during a retort or hot fill process.

SUMMARY OF THE INVENTION

It is an object of the present invention to provide a container neck which promotes drainage of process bath water where the tamper-indicating band is in close proximity to the tamper-indicating bead of the container neck.

It is a further object of the present invention to provide a container neck and a closure skirt including threads having draining clearances or paths.

It is yet a further object of the present invention to have a closure having a plurality of drainage slots.

It is another object of the present invention to have a container tamper-indicating bead having at least one, preferably two, diametrically opposed notches therein to promote drainage of hot fill or retort bath water from the closure neck above the tamper-indicating bead.

It is still another object of the present invention to provide a stepped in area of the container neck above the threads to not further reduce the normal clearances between the cap and container finish when an oversized or tabbed innerseal liner is used.

Specifically, the present invention provides a self-draining container neck and closure comprising a container having an upwardly extending neck rising therefrom, the neck including an upper sidewall portion and a lower sidewall portion. The neck may have at least one container thread helically extending about the neck circumference through a vertical distance. Beneath the at least one thread is a tamper-indicating bead having at least one, preferably two draining notches in a spaced configuration. The tamper-indicating bead on the container neck should have a depth that is greater than the cooperating inwardly projecting bead on the closure in the case where the tamper-indicating or closure retainer bead is continuous rather than notched. Moreover, it is well within the scope of the present invention that the container neck comprise additional notches to aid in draining the neck area. The notches may be substantially U-shaped allowing flow of water between the closure and container threads from the neck through the tamper-indicating band. An upper surface of the tamper-indicating bead on the container neck may have an angle of less than 45 degrees from the vertical to promote drainage from the neck area.

Above the tamper indicating bead and disposed along the container neck is at least one thread. The at least one thread helically extends about the neck preferably about 1–¼ turns and may be a six pitch thread. However, it is within the scope of this invention that single, double, or other multiple helices may be disposed about the circumference of the container neck. The at least one container thread and cap thread and the sidewall preferably form a drainage path which facilitate draining of the process water.

The container neck further comprises an upper sidewall portion and a lower sidewall portion with a centrally disposed neck bore extending therethrough. The upper sidewall portion extends above the at least one thread, preferably about ¼" and is inset from the lower sidewall portion. The upper sidewall portion is inset preferably about twenty-thousandths of an inch. The height and amount of inset of the upper neck portion allows seating of the foil overhang or tabs therein which inhibits the foil innerseal from being confined to a normally small clearance between the closure and container threads and thereby tending to retain process fluids.

Threadably positioned on the container neck may be a closure. The closure comprises a top wall and an annular skirt depending from a peripheral edge of the top wall. Helically extending along an inner surface of the annular skirt is a closure thread. Also included in the closure may be a plurality of drainage slots disposed along a top wall and skirt of the closure. The drainage slots allow hot fill or retort bath water to reach the container neck beneath the closure and sterilize the area as well as aiding in draining when the retort process is finished. The package may be inverted to drain the water or air may be blown through the slots or up between the closure and finish from the bottom of the closure. In any cases described, blown air, impacting, vibrating or inverting may be used to assist in water removal.

All of the above outlined objectives are to be understood as exemplary only and many more objectives of the invention may be gleaned from the disclosure herein. Therefore, no limiting interpretation of the objectives noted is to be understood without further reading of the entire specification, claims, and drawings included herewith.

BRIEF DESCRIPTION OF THE DRAWINGS

The aspects and advantages of the present invention will be better understood when the detailed description of the preferred embodiment is taken in conjunction with the accompanying drawings, in which.

DETAILED DESCRIPTION OF THE PREFERRED EMBODIMENT

Figure 1:
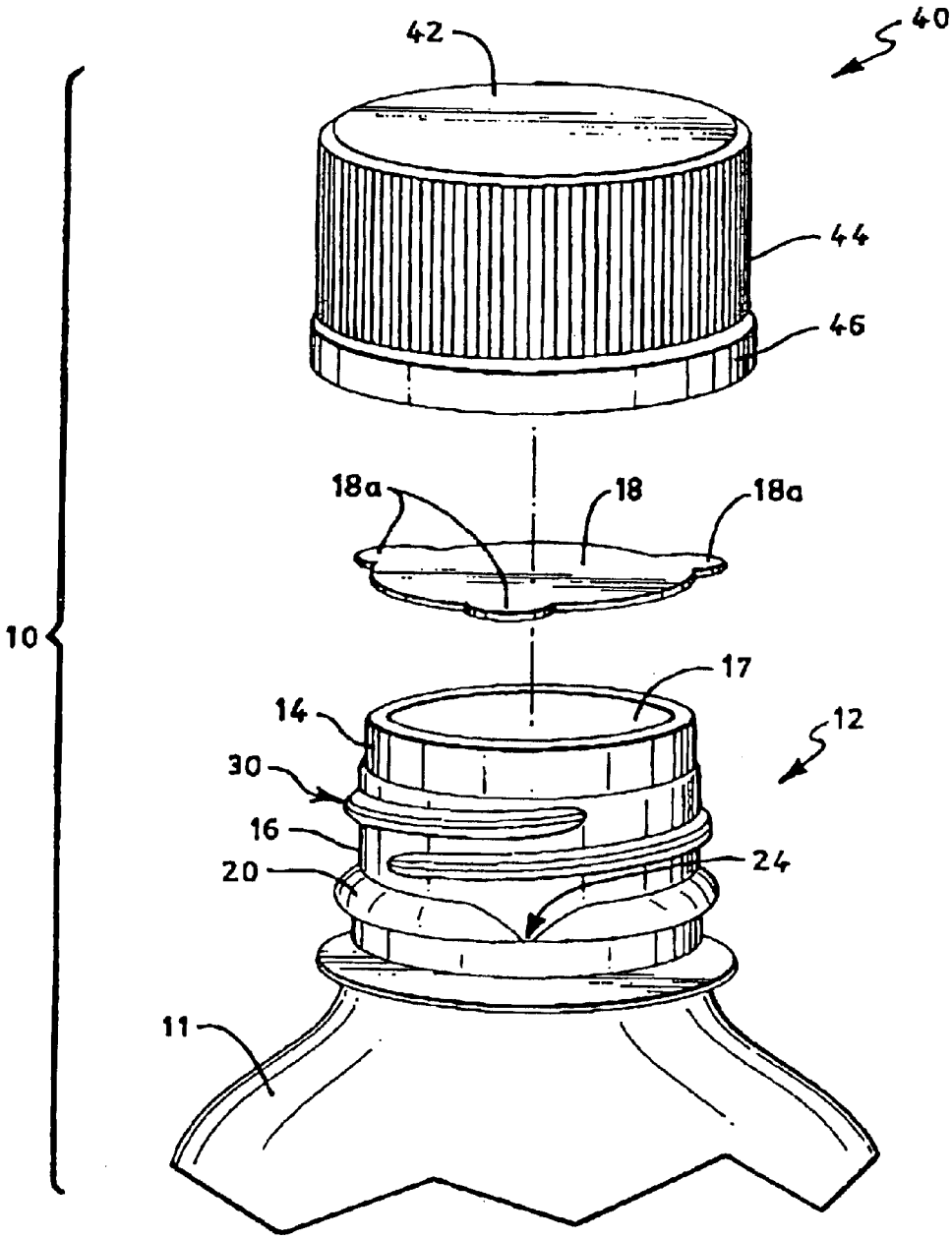
FIG. 1 shows an exploded perspective view of a self-draining container neck and closure of the present invention.

The present invention will now be described in conjunction with the drawings, referring initially to FIGS. 1 and 2, a self-draining container neck and closure assembly 10 is shown for use with a thermal sterilization retort process. During a hot fill or retort process a closure and container are placed in a process bath wherein the container and closure are introduced to either a high or low temperature and pressure bath. The design of the instant invention promotes drainage of process bath water from between the closure 40 and the container neck 12 when the container 11 is removed from the bath. This inhibits bacterial and other unpleasant growths from the container neck 12.

The container neck 12 includes an upper sidewall portion 14 and a lower sidewall portion 16 connected by a step 15. The step 15 may be a tapered step, a rounded step, or a horizontal step. The upper and lower sidewalls 14,16 include a centrally disposed bore 17 extending therethrough creating a flow communication path between the container 11 and neck 12. The container neck 12 including upper and lower sidewall portions 14,16, is substantially cylindrical in shape. The container neck 12 and container 11 may be formed of a rigid material including glass or a semi-rigid polymeric material including a polypropylene and polyethylene, or some other plastic known in the art for use in a compression molding or injection molding process. However, the material used in forming the container 11, container neck 12, and closure 40 should be one which can withstand the heat and pressure of the thermal sterilization process.

The upper sidewall portion 14 has an outer diameter which is slightly smaller than the outer diameter of the lower sidewall portion 16. This difference in upper and lower sidewall portion diameters causes a slight inset of the upper sidewall portion 14. During processing, a container is filled with contents and sealed with a peelable foil seal 18. The peelable foil seal 18 has at least one pull-tab 18*a* which enables an end-user to remove the foil seal 18. As depicted in the present embodiment, a plurality of tabs 18*a* may be arranged in a spaced configuration. Most preferably the foil seal 18 has three tabs 18*a* equidistantly spaced apart. With prior container necks, foil tabs become pinched between the closure and the container neck. This leads to problems such as trapping process liquid. However with the instant embodiment, the height and inset of the upper neck portion 14 allows the tabs 18*a* of the foil seal 18 to be folded downward and located within the inset, remaining clear of at least one container thread 30.

In accordance with one embodiment of the instant invention the upper sidewall portion 14 has an inset height of about ¼" extending above the at least one container thread 30. Thus, in this embodiment the foil tab 18*a* is preferably less than ¼" in length so as not to extend beyond the inset of the upper sidewall portion 14. In addition, in this embodiment the upper sidewall portion 14 is inset about twenty-thousandths of an inch and therefore the thickness of the foil tabs 18*a* should be less than twenty-thousandths of an inch. However, it is well within the scope of the instant invention that the inset and height of the upper sidewall portion may increase or decrease and may therefore cause variation in the dimensions of the foil tabs 18*a* or any circumferential foil overhang.

Helically extending about the sidewall lower portion 16 of the container neck 12 is at least one thread 30. As exemplified in FIGS. 2,4, and 5, the at least one container thread 30 has a vertical thickness which is less than a pre-selected height or gap "G" measured between consecutive thread rotations of the closure thread 50. The difference between the pre-selected height "G" and the container thread 30 thickness forms a gap or drainage path 31. The drainage path 31, defined by the difference between closure thread thickness and container thread gap or container thread 50 thickness and closure thread gap "H" may provide a clearance of at least about 0.03125" for single lead threads and at least about 0.375" for dual lead threads. Thus any combination of closure thread thickness and container thread gap or container thread thickness and closure thread gap meeting this limitation will do. However, it is well within the scope of this invention that the thread design and thickness may vary in order to promote drainage, including for example multiple lead threads on the closure 40 and container neck 12.

Figure 2:
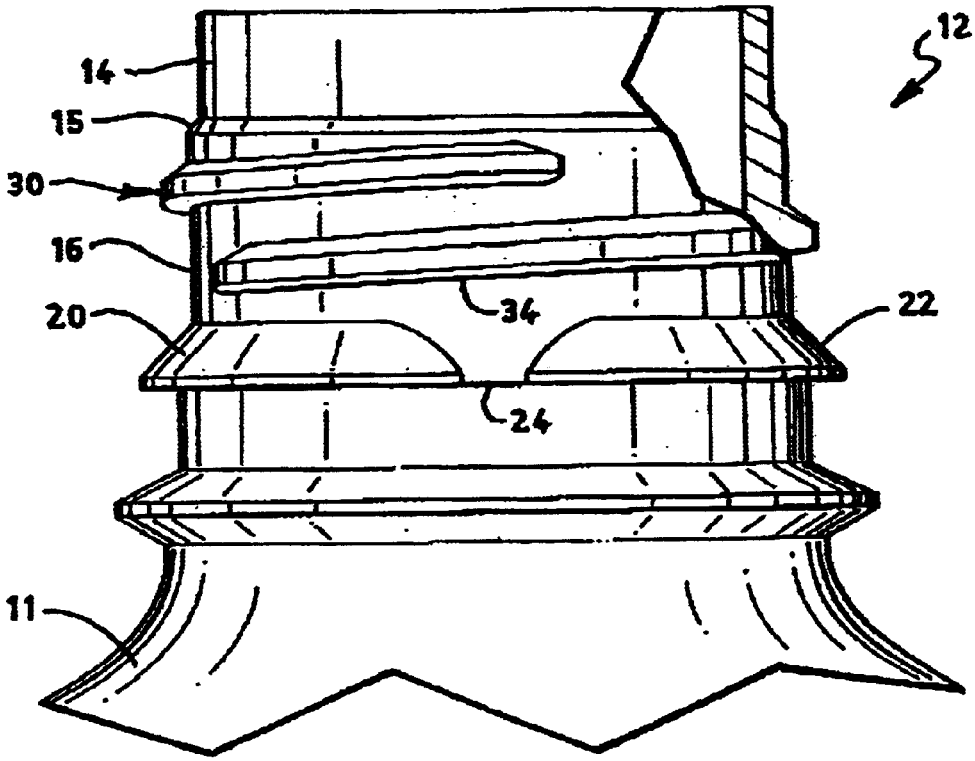
FIG. 2 shows a side view of the container neck of FIG. 1 with a partial sectional view of the upper sidewall portion of the neck.
Figure 3:
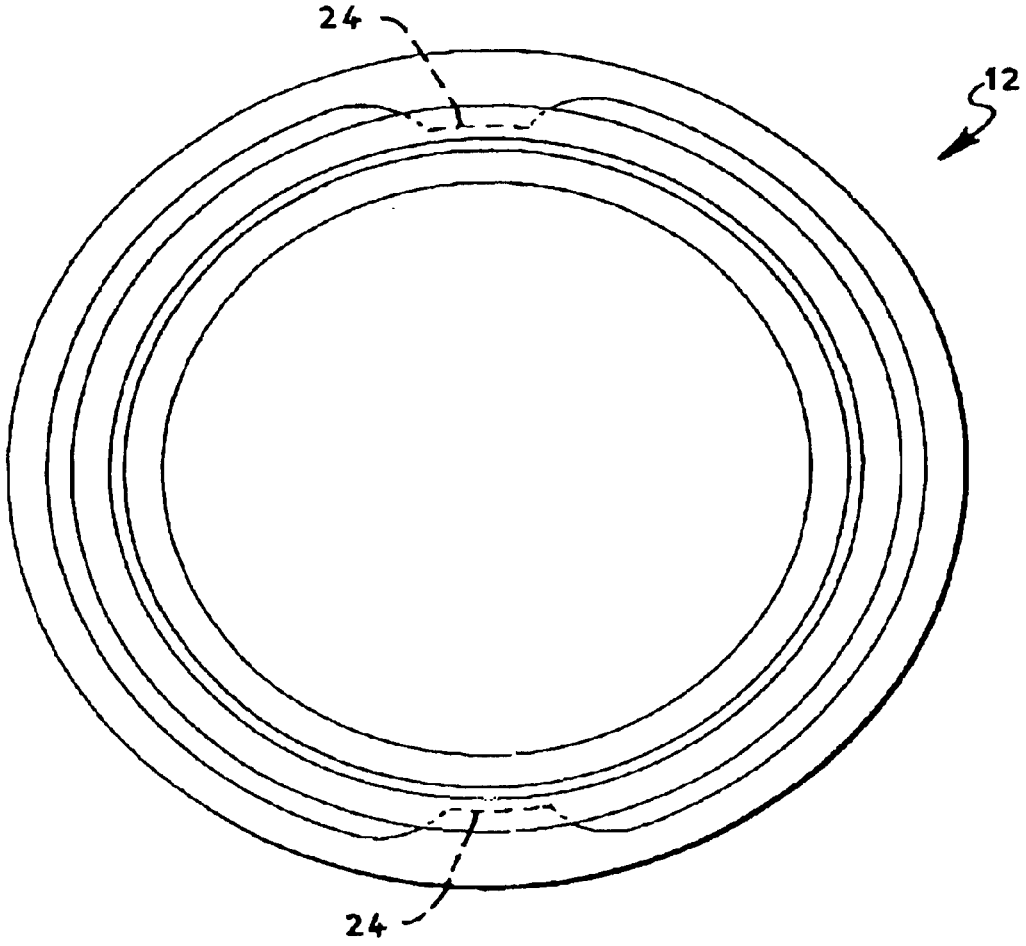
FIG. 3 shows a top view of the container neck of the present invention.

Referring now to FIGS. 1 and 2, circumferentially extending about the neck 12 beneath the at least one thread 30 is a tamper-indicating bead 20. A tamper-indicating band or ring 46 which is frangibly connected to the closure 40 slides over the tamper-indicating bead 20 so that when the closure 40 is threadably removed from the container neck 12 the tamper-indicating band 46 is left in place indicating to a user that the container has been previously opened. The tamper-indicating bead 20 also includes at least one notch 24 therein. The at least one notch 24 may be a plurality of shapes and, as exemplified in FIG. 3, may be somewhat U-shaped. The at least one notch 24 allows water disposed between the container neck 12 and closure 40 during the retort or hot fill bath to drain inhibiting bacterial growth and the like. In the instant embodiment, there are two diametrically opposed notches 24, however various spaced configurations may be used and are considered within the scope of this invention. The tamper-indicating bead 20 has an upper bead face 22 extending outwardly and downwardly and may be at an angle of about 45 degrees. A steep upper bead face 22 is preferred for promoting drainage however, the upper bead face 22 should not be so steep that it comes into close proximity to the closure thread surfaces, above, such that drainage is impaired.

Figure 5:
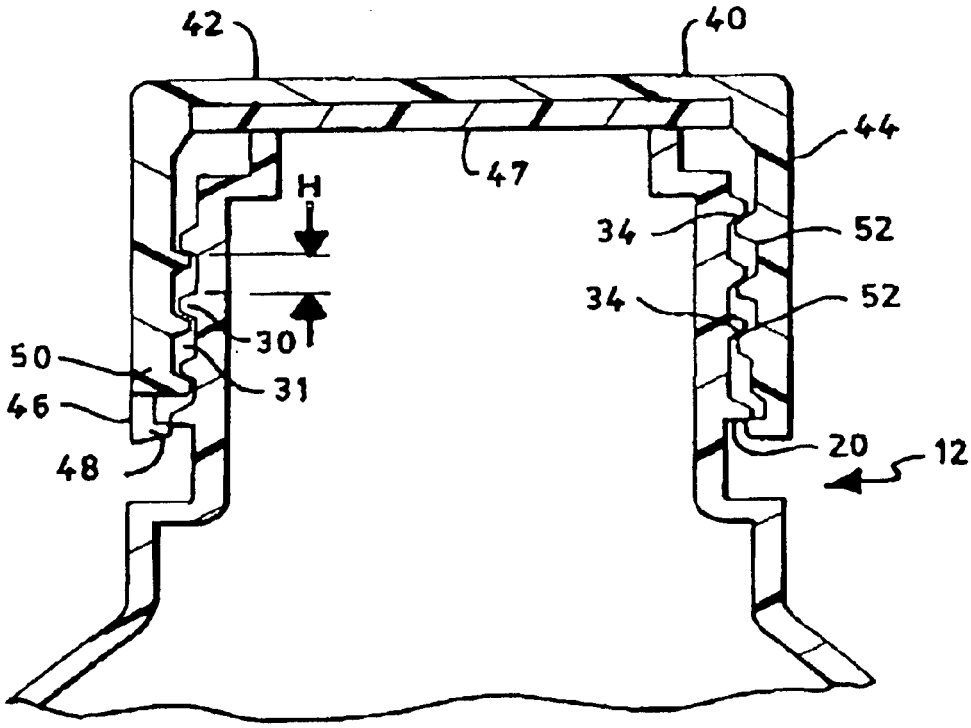
FIG. 5 shows a sectional view of the closure of FIG. 1 threadably engaging the container neck.
Figure 6:
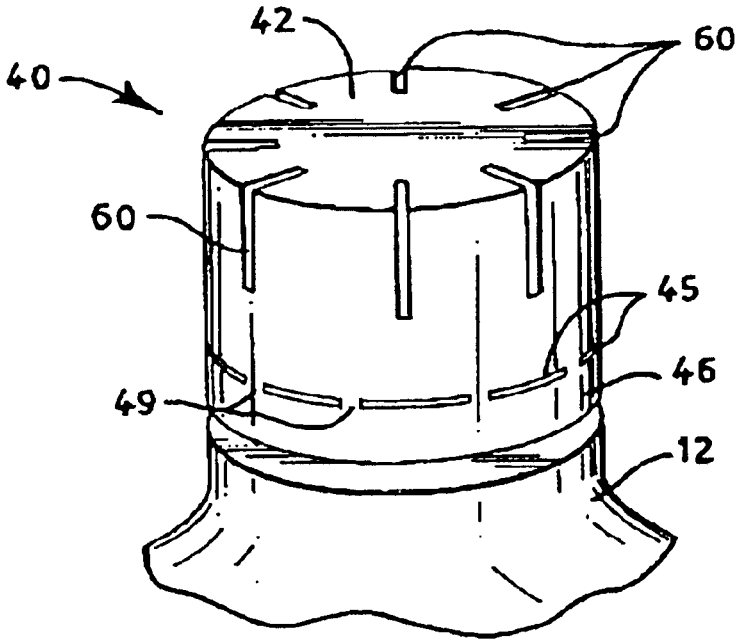
FIG. 6 shows a closure having a plurality of drainage slots.

As shown in FIGS. 1,5, and 6, a closure 40 is placed over the container neck 12 and may be threadably attached thereto. The closure 40 is preferably made of a rigid or semi-rigid polymeric material, such as polypropylene capable of withstanding heat and pressure characteristics associated with thermal sterilization processes.

Figure 4:
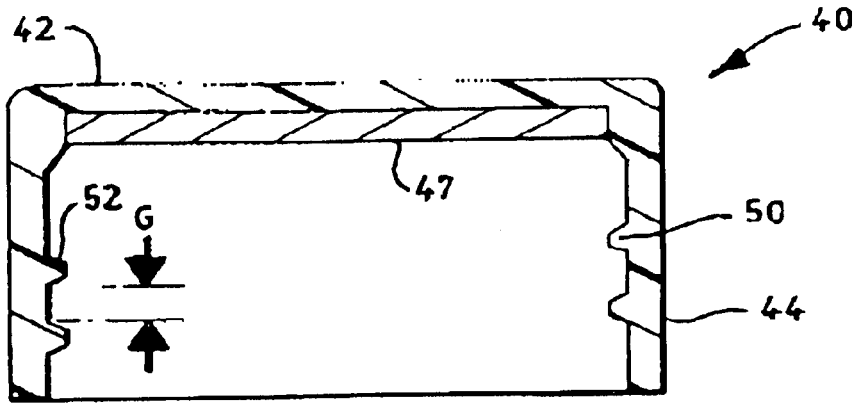
FIG. 4 shows a sectional view of the closure of FIG. 1.

The closure 40 may be formed by, for instance, either compression molding or injection molding. The closure 40 has a circular top wall 42 with an exterior and an interior surface. The closure 40 further comprises an annular skirt 44 depending from the top wall 42 and has at least one closure thread 50 helically extending along an inner surface of the annular skirt 44 for engaging the at least one thread 30 of the container neck 12. As seen in FIG. 4, the at least one closure thread 50 has a vertical thickness which is less than a pre-selected height or gap "H" measured between consecutive rotations of the container thread 30. For example the closure thread vertical thickness 50 may be one-half the gap "H". Alternatively the thread thickness of the container thread 30 may be less than the gap "G" between thread rotations on the closure 40. In either case a drainage path 31 should be formed as set forth herein.

A lower peripheral edge of the annular skirt 44 defines an opening wherein the container neck 12 can be threadably positioned. As depicted in FIG. 5, when the closure 40 is threadably applied to the container neck 12, the closure upper thread face 52 contacts the container lower thread face 34 so as to pull the closure 40 down the container neck 12. A drainage path 31 is formed between the closure thread 50 and container thread 30, defined by the difference in thread thickness and gap between consecutive rotations of either closure thread 50 and container gap "H" or container thread 30 and closure gap "G" wherein the bath water can drain. As depicted in FIGS. 5 and 6, a reseal liner 47 may be located along an inner surface of the top wall 42. The reseal liner 47 seals the closure against the mouth of the container neck bore 17 to prevent spillage of the container 11 contents after the foil seal 18 is removed. The reseal liner 47 may be formed of some resilient material which can withstand the effects of the thermal sterilization and cooling process.

As shown in FIGS. 5 and 6, frangibly connected to the lower peripheral edge of the annular skirt 44 is a tamper-indicating band 46 having an interference bead 48. When the closure 40 is threadably applied to the container neck 12, the interference bead 48 moves past the tamper-indicating bead 20 and is held in place. The interference bead 48 exemplified in the embodiment of FIG. 5 does not completely extend radially inward to the container neck 12 in order that water can drain through the notches 24. However, the interference bead 48 may extend radially inward to the container neck 12 when notches are made in the interference bead 48 allowing drainage therethrough. Alternatively, the tamper-indicating bead 48 may be any of the variations commonly used including, for instance, a flexible folding finger design.

Figure 7:
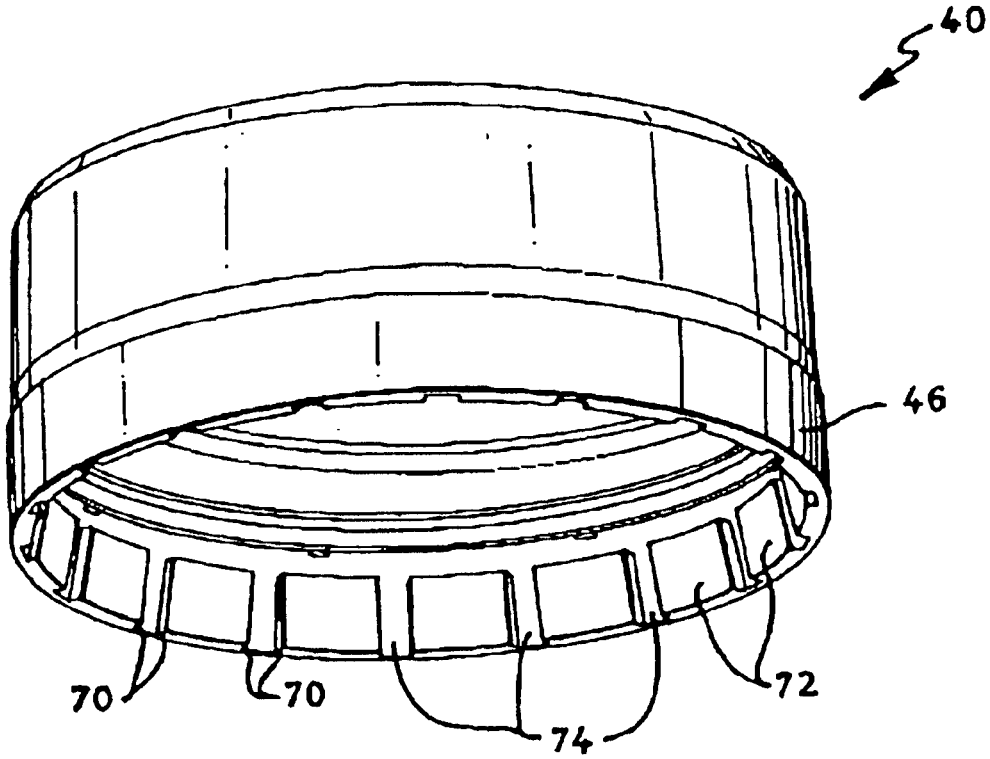
FIG. 7 shows a perspective view of the closure of FIG. 1 having a plurality of flexible folding fingers extending from a tamper indicating band.

As shown in FIG. 7, flexible folding finger hinges are 70 is shown along an inner surface of the tamper-indicating band 46. Extending inward from the flexible folding finger hinge 70 are a plurality of flexible folding fingers 72. Disposed between the flexible folding fingers 72 is at least one, preferably a plurality of drainage gaps 74 allowing process bath water to drain therefrom.

As discussed above, when the closure 40 is threadably removed, the interference bead 48 cannot pass the tamper indicating bead 20 and the frangible connections break leaving the tamper-indicating band 46 disposed around the neck 12. This notifies a user that the container has been previously opened.

As shown in FIG. 6, the closure 40 may also include a plurality of drainage slots 60. The drainage slots 60 may extend from the closure top wall 42, through the intersection of the closure top wall 42 and the closure skirt 44, and through the closure skirt 44. The drainage slots 60 may be formed during the molding process or may be cut therein after molding and allow bath water to enter the area of the container enclosed by the closure 40 so as to properly sterilize and also allow for drainage from the area. The drainage slots 60 may be equidistantly spaced about the circumference of the closure 40 and may be positioned in a plurality of spaced configurations. However, the slots 60 may be used with or without the tamper-indicating feature. In any case, the slots 60 in the top wall 42 combined with the natural opening at the bottom of the closure, provide a flow-through path for any blow air used and, minimize air lock which can inhibit draining.

Figure 8:
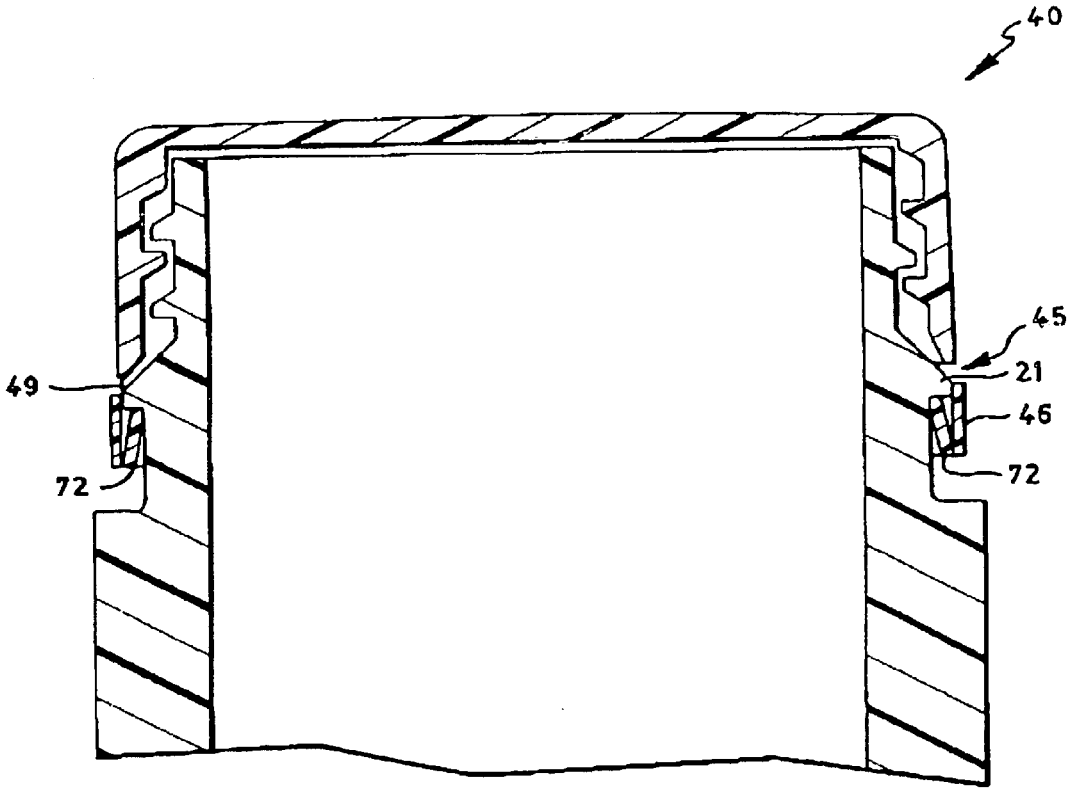
FIG. 8 shows a sectional view of the closure of FIG. 1 having a tamper-indicating band with folding fingers threadably connected to a container neck.

As shown in FIGS. 6 and 8, the frangible connection of the tamper-indicating band 46 may be formed with a plurality of windows 45 that also serve to promote drainage of process bath water. The plurality of windows or tamper-indicating band gaps 45 may be created by an interrupted knife cut wherein the vertical length or height of the windows 45, and webs 49 there between, is short. An alternative method of manufacturing the windows 45 is to mold the windows 45 and webs 49. As exemplified in FIG. 8, the windows 45 may have a height of at least 0.03125" and preferably about 0.0625". However this height may vary in dimension and should be positioned above a neck bead apex 21. By positioning the gaps or windows 45 in a spaced relationship slightly above on the neck bead apex 21 an drain path is created above the neck bead 20 such that the process bath water may drain inhibiting bacterial growth.

Figure 9A:
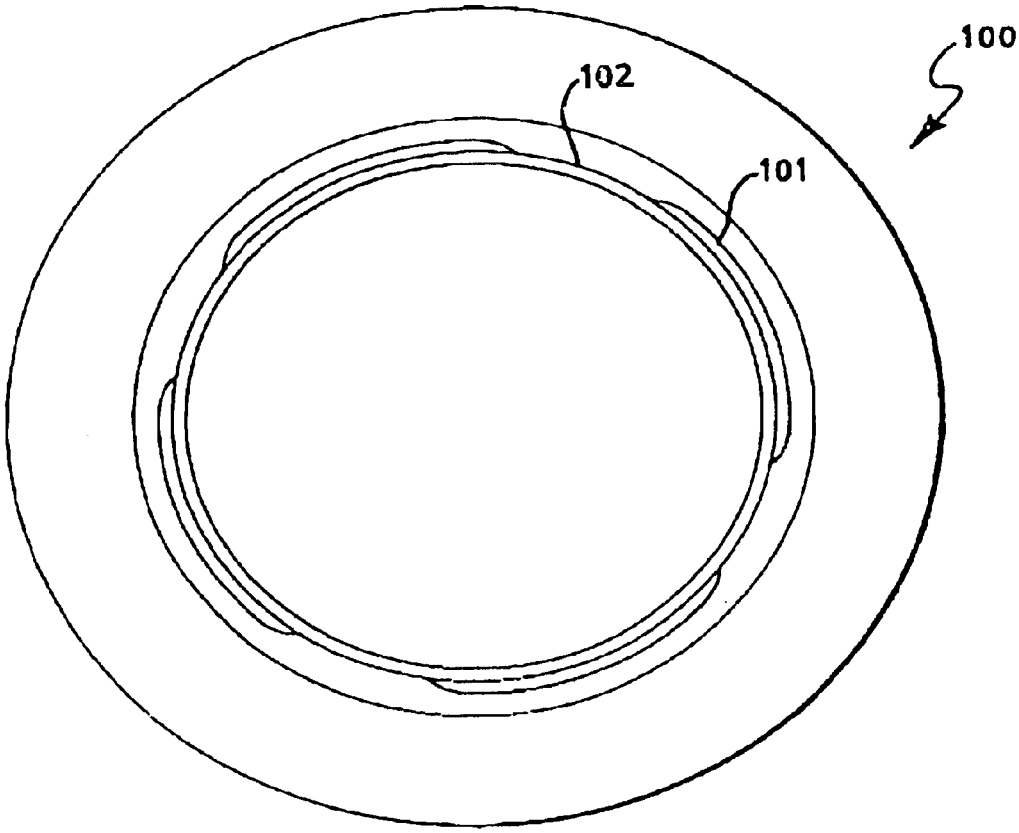
FIG. 9*a* details a top view of a multi-thread finish for use with the present invention; and, FIG. 9*b* details a side view of the finish of FIG. 9*a*.
Figure 9B:
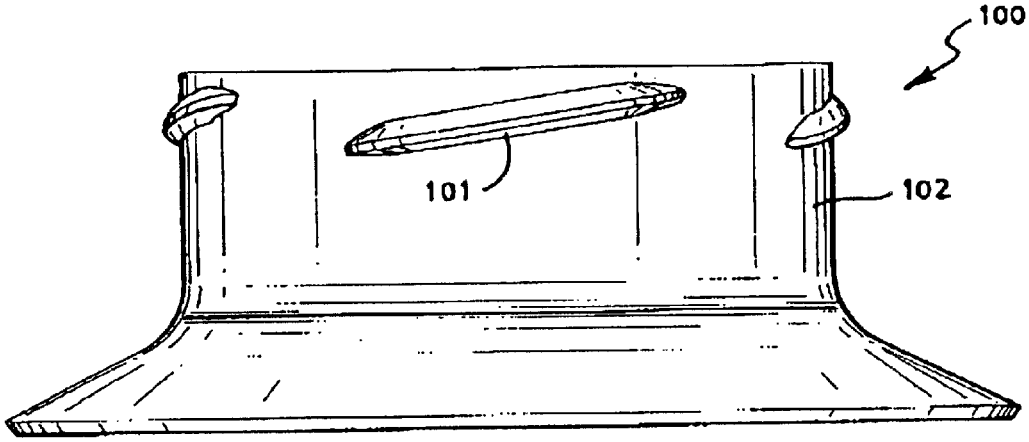

Finally, detailed in FIGS. 9*a* and 9*b*, the finish may be adjusted with multi-thread design such that a plurality of threads, each of which may be less than 90 degrees in arc length, provides sufficient area to create drainage paths between thread segments.

The foregoing detailed description is given primarily for clearness of understanding and no unnecessary limitations are to be understood therefrom for modifications will become obvious to those skilled in the art upon reading this disclosure and may be made without departing from the spirit of the invention and scope of the appended claims.

We claim:

1. A self-draining container neck and closure, comprising:

a closure having a top wall, an annular skirt extending from a peripheral edge of said top wall, and at least one closure thread extending along an inner surface of said annular skirt, said at least one closure thread having a pre-selected height between consecutive rotations of said at least one closure thread;

a container having a container neck extending upwardly therefrom;

at least one container thread helically extending about said container neck, said at least one container thread having a vertical thickness less than said pre-selected height of said at least one closure thread; and, a tamper-indicating bead disposed beneath said at least one container thread, said tamper-indicating bead having at least one draining notch therein.

2. The self-draining container neck and closure of claim 1, said tamper-indicating bead having two diametrically opposed draining notches.

3. The self-draining container neck and closure of claim 2, said diametrically opposed notches being substantially U-shaped.

4. The self-draining container neck and closure of claim 1, said container neck having an upper sidewall portion and a lower sidewall portion, said upper portion having a smaller outer diameter than said lower portion forming an inset.

5. The self-draining container neck and closure of claim 4, said upper sidewall portion being inset about twenty-thousandths of an inch from said lower portion.

6. The self-draining container neck and closure of claim 5, said container neck further comprising a foil seal disposed across a centrally disposed bore in said container neck.

7. The self-draining container neck and closure of claim 6 further comprising at least one tab extending from a peripheral edge of said foil seal.

8. The self-draining container neck and closure of claim 7, said at least one tab being folded and positioned in said inset.

9. The self-draining container neck and closure of claim 1, said container thread having a thickness about one-half of said pre-selected height between consecutive rotations of said closure thread.

10. A self-draining closure in combination with a self-draining container neck, comprising:

a closure having a top wall and an annular skirt depending from a peripheral edge of said top wall;

at least one closure thread helically extending about an inner surface of said annular skirt, said at least one closure thread having a pre-selected height defined between consecutive rotations of said closure thread;

a plurality of drainage slots extending through said closure adjacent an intersection of said closure top wall and said annular skirt;

a container neck having at least one container thread, said at least one container thread having a pre-selected height defined between consecutive rotations of said at least one container thread, said at least one container thread having a vertical thickness less than said pre-selected height of said closure thread;

said at least one closure thread having a vertical thickness less than said pre-selected height of said container thread;

said at least one closure thread engaging said at least one container thread and forming a drainage path.

11. The self-draining closure of claim 10, said closure having a tamper-indicating ring frangibly connected to a lower edge of said annular skirt.

12. The self-draining closure of claim 11, said tamper-indicating ring having a closure tamper-indicating bead extending radially inward therefrom.

13. The self-draining closure of claim 12, said closure tamper-indicating bead having a plurality of slots therein.

14. The self-draining closure of claim 12, said tamper-indicating ring having a plurality of flexible folding fingers extending radially inward therefrom, said folding fingers having a plurality of gaps therebetween.

15. The self-draining closure of claim 10 further comprising a tamper-indicating bead circumferentially extending about said container neck, said bead having at least one draining notches therein.

16. The self-draining closure of claim 10, said at least one container thread having a vertical thickness about one-half said pre-selected height of said closure thread.

17. The self-draining closure of claim 10, said at least one closure thread having a vertical thickness about one-half said pre-selected height of said container thread.

18. A self draining container neck and closure, comprising:

a closure having a top wall and an annular skirt depending therefrom, and at least one closure thread helically extending about an inner surface of said closure skirt;

said at least one closure thread having a closure thread gap defined by a vertical distance between consecutive rotations of said at least one closure thread;

a container having a container neck extending upwardly therefrom including an upper sidewall portion and a lower sidewall portion, said upper sidewall portion being inset from said lower sidewall portion;

at least one container thread helically extending about said neck and having a container thread gap defined by a vertical distance between consecutive rotations of said at least one container thread;

said at least one container thread having a vertical thickness less than said closure thread gap;

said closure thread having a vertical thickness less than said container thread gap;

a tamper indicating bead disposed beneath said at least one container thread extending about said lower sidewall portion, said tamper indicating bead having at least one draining notch therein and, said closure threadably connected to said container neck.

19. The self-draining container neck and closure of claim 18, said tamper-indicating bead having a plurality of draining notches, said notches being substantially U-shaped.

20. The self-draining container neck and closure of claim 18, said container neck further comprising a centrally disposed bore defining a flow communication path extending through said neck and a foil seal extending across said centrally disposed bore, said seal having at least one tab extending from a peripheral edge.

21. The self-draining container neck and closure of claim 20, said foil seal having three tabs extending outward from a peripheral edge of said foil seal.

22. The self-draining container neck and closure of claim 20, said at least one tab being folded and positioned against said inset upper sidewall portion.

23. The self-draining container neck and closure of claim 21, said upper sidewall portion being inset about twenty-thousandths of an inch.

24. The self-draining container neck and closure of claim 18, said closure further comprising a plurality of drainage slots extending through said closure.

25. The self-draining container neck and closure of claim 18, said closure further comprising drainage slots extending through said annular skirt.

26. The self-draining container neck and closure of claim 25, said closure further comprising a tamper-indicating band frangibly connected to a lower peripheral edge of said annular skirt, said tamper-indicating band having a closure tamper-indicating bead extending radially inward in interference relationship with said tamper indicating bead of said container.

27. A self-draining container neck and closure, comprising:

a container having a container neck extending upwardly therefrom;

said container neck having an upper sidewall portion and a lower sidewall portion, said upper sidewall portion being inset from said lower sidewall portion and forming a step;

a closure having at least one closure thread, said at least one closure thread having a pre-selected closure thread gap between consecutive thread rotations of said closure thread;

at least one container thread helically extending about said neck, said at least one container thread having a pre-selected container thread gap between consecutive rotations of said container thread, said at least one container thread having a vertical thickness about one-half said pre-selected closure thread gap;

said closure thread having a thickness about one-half said pre-selected container thread gap and, a tamper-indicating bead disposed beneath said at least one container thread extending about said container neck, said tamper-indicating bead having at least one draining notch therein.

28. The self-draining container neck and closure of claim 27, said tamper-indicating bead having a plurality of U-shaped draining notches.

29. The self-draining container neck and closure of claim 28, said closure having a plurality of drainage slots extending through a closure top wall and an annular skirt.

30. The self-draining container neck and closure of claim 27, said container neck having a centrally disposed bore defining a flow-communication path and a foil seal disposed across said centrally disposed bore, said foil seal having at least one tab spaced about a peripheral edge of said foil seal, said at least one tab disposed within said inset upper sidewall portion.

31. The self-draining container neck and closure of claim 27, said upper sidewall portion being inset about twenty-thousandths of an inch.

32. A self-draining container neck and closure, comprising:

a container having a container neck extending upwardly therefrom;

said container neck having an upper sidewall portion and a lower sidewall portion, said upper sidewall portion being inset from said lower sidewall portion and forming a step;

a closure having a top wall, an annular skirt depending from a peripheral edge of said top wall, and at least one closure thread, said at least one closure thread having a closure thread gap defined by a distance between consecutive rotations of said at least one closure thread;

at least one container thread helically extending about said neck, said container thread having a container thread gap defined by a distance between consecutive rotations of said at least one container thread;

said at least one container thread having a vertical thickness less than said closure thread gap of said at least one closure thread;

said at least one closure thread having a vertical thickness less than said container thread gap of said at least one container thread;

a tamper-indicating bead disposed beneath said at least one container thread circumferentially extending about said lower sidewall portion, said tamper-indicating bead having at least one draining notch therein;

at least one drainage slot extending through said closure adjacent said top wall and said annular skirt;

said at least one closure thread engaging said at least one container thread and forming a drainage path; and, said self-draining closure having a tamper-indicating band frangibly connected to a lower edge of said closure annular skirt positioned adjacent said tamper-indicating bead said container neck.

33. The self-draining closure of claim of claim 32, said tamper-indicating band having a flexible folding fingers extending radially inward from an inner surface of said tamper-indicating band.

34. The self-draining closure of claim 33, said folding fingers having a plurality of drainage gaps therebetween.

35. The self-draining closure in combination with a self-draining container neck, comprising:

a closure having a top wall and an annular skirt depending from a peripheral edge of said top wall;

at least one closure thread helically extending about an inner surface of said annular skirt;

said at least one closure thread having a pre-selected height defined between consecutive rotations of said closure thread;

a container neck having at least one container thread extending helically about said neck, said at least one container thread having a pre-selected height defined between consecutive rotations of container thread;

said at least one container thread having a vertical thickness less than said closure pre-selected height;

said at least one closure thread having a vertical thickness less than said container pre-selected height;

said at least one closure thread engaging said at least one container thread and forming a drainage path;

said container neck having a tamper-indicating bead located below said at least one container threads, said tamper-indicating bead having at least one draining notch therein;

said closure having a tamper-indicating band frangibly connected to a lower edge of said closure;

said frangibly attached closure tamper-indicating band having a plurality of windows therein and a plurality of connector webs between said windows;

said windows being in a spaced relationship with an apex of said container neck tamper-indicating bead.

36. The combination of claim 35, said tamper-indicating band having a plurality of flexile folding fingers extending radially inward from said tamper-indicating band, said folding fingers having a plurality of gaps there between.

37. A self-draining container neck and closure, comprising:

a container neck having an upper portion and a lower portion, said upper portion having a smaller outer diameter than said lower portion forming an inset;

a foil seal disposed over a bore extending through said neck;

a container thread helically extending about said lower portion of said container neck;

a tamper-indicating bead disposed beneath said container thread, said tamper-indicating bead having at least one draining notch therein:

a closure having a top wall and a skirt depending from a peripheral edge of said top wall;

a closure thread helically extending about an inner surface of said closure skirt, said closure thread having a pine-selected closure thread gap defined by a distance between consecutive rotations of said closure thread;

said closure threadably connected to said container neck, said container thread and said closure thread forming a drainage path there between.

38. The container neck and closure of claim 37, said container thread having a vertical thickness less than said pre-selected closure thread gap.

39. The container neck and closure of claim 37, said container thread having a pre-selected container gap defined by a distance between consecutive rotations of said container thread.

40. The container neck and closure of claim 39, said closure thread having a vertical thickness less than said pre-selected container gap.

41. The container neck and closure of claim 37, said inset being about twenty-thousandths of an inch.

42. The container neck and closure of claim 37, said closure having a plurality of drainage slots extending through said top wall and said skirt.

43. The container neck and closure of claim 37, said foil seal having at least one tab extending from a peripheral edge of said foil seal.

44. A self draining container neck and closure wherein a self-draining path exists there between, comprising:

a closure having a top wall, an annular skirt extending from said top wall, and at least one closure thread extending along an inner surface of said annular skirt, said at least one closure thread having a pre-selected vertical clearance between consecutive rotations of said at least one closure thread;

a container having a container neck extending upwardly therefrom, at least one container thread helically extending about said container neck, said at least one container thread having a container thread vertical thickness less than said pre-selected vertical clearance between said closure thread;

a bead disposed beneath said at least one container thread, said bead having at least one draining notch therein;

said closure threadably connected to said container neck, said container thread and said closure thread forming a drainage path there between.

45. The self-draining container neck and closure of claim 44 wherein said closure thread vertical clearance is at least 0.020" more than said container thread vertical thickness.

46. The self-draining container neck and closure of claim 44, wherein one of either said closure or container thread is more than 0.020" radially deeper than the other.

47. The self-draining container neck and closure of claim 44, wherein said closure thread extends around and engages said container thread over less than 360°.

48. The self-draining container neck and closure of claim 44 where both the closure and the container have four threads and the thread segments are less than 90° in are length.

49. The self-draining closure of claim 44, further having at least one bead or finger directed inwardly from the bottom of said annular skirt forming a removable band, said band having frangible connectors and gaps there between located above said at least one bead or finger thereby creating a frangible connection.

50. The self-draining container neck and closure of claim 44, wherein the bead through which the said notch passes consists of one contact diameter surface with the closure.

51. The self-draining container neck and closure of claim 44 wherein the bead through which the notch passes consists of an upper and lower diameter contact surface contacting a closure frangible skirt portion.

52. The self-draining container neck and closure of claim 44 further having a cylindrical surface below the bead through which the notch passes, which makes contact with a closure frangible skirt inwardly directed bead, said inwardly directed bead having at least one notch.

53. The self-draining closure of claim 50 wherein said at least one finger directed inwardly from the bottom edge of the said annular skirt consists of multiple fingers with gaps there between, said gaps at least as wide as the said notch in said container bead and wherein said fingers and gaps are positioned such that a gap is 180° opposed to a finger so as to not restrict the draining characteristics of said notch.

54. A container neck and closure wherein a self-draining path exists there between, comprising:

a closure having a top wall, an annular skirt extending from said top wall, and at least one closure thread extending along an inner surface of said annular skirt, said at least one closure thread having a pre-selected closure thread vertical clearance between consecutive rotations of said at least one closure thread;

a plurality of frangible connector webs having gaps therebetween located below said thread, and at least one inwardly directed bead or finger connected to the lower edge of the annular skirt, a container having a container neck extending upwardly therefrom, at least one container thread helically extending about said container neck, said at least one container thread having a vertical thickness; and, a bead located beneath said at least one container thread having an outermost diameter of at least 0.020" per side smaller in diameter than the inside surface of said closure annular skirt and being larger in diameter than the inside diameter of said closure bead or fingers, said bead having at least one drainage notch;

said closure threadably connected to said container neck, said container neck and said closure forming a drainage path there between.

55. The self-draining container neck and closure of claim 54 wherein said closure thread vertical clearance is at least 25% more than said container thread vertical thickness.

56. The self-draining container neck and closure of claim 54, wherein one of either said closure or container thread is more than 25% radially deeper than the other.

57. The self-draining container neck and closure of claim 54, wherein at least one of either of the at least one closure or container thread extends around and engages the other over less than 360°.

58. The self-draining container neck and closure of claim 57 where both the closure and the container have four threads and the thread segments are less than 90° in arc length.

* * * * *

UNITED STATES PATENT AND TRADEMARK OFFICE

CERTIFICATE OF CORRECTION

PATENT NO. : 6,948,630 B2
APPLICATION NO. : 10/277072
DATED : September 27, 2005
INVENTOR(S) : Julian et al.

It is certified that error appears in the above-identified patent and that said Letters Patent is hereby corrected as shown below:

Col. 1, Line 63 “oversize” should be -- oversized --;

Col. 6, Line 14 “70” should be after “hinges”, instead of “are”;

Col. 6, Line 58 delete “an” and insert -- a -- after “21”;

Col. 9, Line 11 add -- - -- between “tamper” and “indicating”;

Col. 10, Line 22 delete second phrasing of “of claim”;

Col. 10, Line 23 delete “a” after “having”;

Col. 11, Line 13 delete “pine” and insert -- pre --;

Col. 11, Line 66 Claim 48, delete “are” and insert -- arc --;

Col. 12, Line 41 delete “and” after “thickness;” and insert -- and -- after “notch;”

Signed and Sealed this

Twentieth Day of May, 2008

JON W. DUDAS
*Director of the United States Patent and Trademark Office*